US006564564B2

(12) United States Patent
Heiden et al.

(10) Patent No.: US 6,564,564 B2
(45) Date of Patent: May 20, 2003

(54) PURGE

(75) Inventors: Richard M. Heiden, Holmen, WI (US); Robert J. Roth, La Crosse, WI (US); Brian T. Sullivan, La Crosse, WI (US); Steven E. Wolfgram, La Crosse, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/015,971

(22) Filed: Oct. 22, 2001

(65) Prior Publication Data

US 2003/0074909 A1 Apr. 24, 2003

(51) Int. Cl.[7] ..... F25B 43/04; F25B 45/00
(52) U.S. Cl. ..... 62/195; 62/475
(58) Field of Search ..... 62/195, 85, 475, 62/55.5, 149, 292

(56) References Cited

U.S. PATENT DOCUMENTS

| | | | | |
|---|---|---|---|---|
| 3,131,552 A | | 5/1964 | McNeely | |
| 4,984,431 A | | 1/1991 | Mount et al. | |
| 5,031,410 A | | 7/1991 | Plzak et al. | |
| 5,515,690 A | | 5/1996 | Blackmon et al. | |
| 5,582,023 A | * | 12/1996 | O'Neal | 62/195 |
| 5,592,826 A | | 1/1997 | Sagar et al. | |
| 5,636,526 A | * | 6/1997 | Plzak et al. | 62/475 |
| 5,806,322 A | | 9/1998 | Cakmakci et al. | |
| 5,910,160 A | * | 6/1999 | Cakmakci et al. | 62/195 |
| 6,260,378 B1 | * | 7/2001 | Sagar | 62/475 |

OTHER PUBLICATIONS

"PRGA/PRGB Purifier Purge® Digital Control", Installation PDCA–IN–1, May 1997.
"Purifier Plus™ Purge Emission Collection Canister", Installation Operation Maintenance PRG–IOM–3D, Nov. 1998.

* cited by examiner

*Primary Examiner*—Denise L. Esquivel
*Assistant Examiner*—Marc Norman
(74) *Attorney, Agent, or Firm*—William J. Beres; William O'Driscoll

(57) ABSTRACT

A purging device for a system accumulating condensable and non-condensable gases. The purging device comprises: a purge tank; apparatus receiving the condensable and non-condensable gases from the system and directing said gases into the purge tank; apparatus condensing the non-condensable gases into a condensed form; apparatus accumulating the non-condensable gases in a header space; apparatus returning the condensed gases from the purge tank to the system; apparatus controllably removing the accumulated non-condensable gases from the header space; and apparatus generating controlled flow in the condensable and non-condensable gases.

21 Claims, 2 Drawing Sheets

10
12
13
14
16
18
18
20
22
23
24
26
28
30
32
34
36
38
40
42
44
46
48
50
52
60
60
62
64
66
68
70
72
80
82
84
86
88
90
92
94
96
100
102
104
106

PURGE

BACKGROUND OF THE INVENTION

A purge system is required on all subatmospheric refrigeration systems, and may be used on non-subatmospheric systems, to remove air, moisture and other noncondensable gases that leak or otherwise enter into the system. The present invention is directed to improvements in such purge systems to reduce the emissions of condensable gases that may accompany the purging or release of the non-condensable gases from the system.

For example, refrigeration systems such as centrifugal chillers, including, for example, the CenTraVac® centrifugal chillers manufactured by The Trane Company, a Division of American Standard Inc., utilize low pressure refrigerants such as CFC11, CFC113, HCFC123 and multi-pressure refrigerants such as CFC-114 and CFC245A to operate at less than atmospheric pressure, either at all times or under a set of operating or standdown conditions. Since the chillers are operating at subatmospheric pressures, air and moisture may leak into the machine through these low pressure areas. Once the air and moisture and other non-condensables enter the chiller, the noncondensables accumulate in the condenser portion of the chiller during machine operation. The non-condensable gases in the condenser reduces the ability of the condenser to condense refrigerant, which in turn results in an increased condenser pressure, and thereby results in lower chiller efficiency and capacity.

A purge device is a device mounted externally to the chiller. The purge device, in its simplest form, consists of a tank, inlet and outlet connections and valves, and an arrangement for cooling the tank. The arrangement for cooling the tank can be a refrigeration system but may also be a source of cold water or other fluid, a fan system, or even cooled refrigerant from the system being purged. The evaporator or cooling coil of the purge refrigeration system is located within the purge tank and is called the purge evaporator. The purge tank is connected to the chiller system by supply and refrigerant lines through which refrigerant may freely flow. The supply line is typically connected to the condenser and the return line may be connected to the condenser or to the evaporator depending upon the inclusion of a device to maintain system pressures. The purge evaporator includes a coil representing a cold condensing surface to the chiller refrigerant entering the tank through the supply line. When the purge refrigeration unit is running, refrigerant from the chiller condenser is attracted to the cold surface of the purge evaporator in the purge tank. When the gaseous refrigerant contacts the cool surface of the purge evaporator coil, the gaseous refrigerant condenses into a liquid, leaving a partial vacuum behind. More refrigerant vapor from the chiller condenser migrates to the purge tank to fill this vacuum. The liquid refrigerant condensed in the purge tank returns to the chiller system via the return line. Any non-condensables in the vapor from the chiller do not condense in the purge tank and are left behind to fill more and more header space in the purge tank. Increasing quantities of noncondensables accumulating in the purge tank act to reduce the heat transfer efficiency of the evaporator coil, and the leaving temperature will begin to decrease in response thereto. The leaving temperature is monitored by the unit controls, which will activate a pumpout cycle to remove accumulated noncondensables from the purge tank. When enough noncondensables have been removed, the increasing purge compressor suction temperature will terminate the pumpout cycle. Such a system is implemented by Trane and sold under the trademark Purifier™, and is further described in U.S. Pat. 5,031,410 to Plzak et al., the disclosures of which are commonly owned and which are incorporated by reference herein.

While the Purifier™ purge has been an industry leader for many years, there are improvements in improving the efficiency of its operation and reducing the percentage of condensable gases escaping with the release of noncondensable gases.

SUMMARY OF THE INVENTION

It is an object, feature and advantage of the present invention to solve the problems of the prior art purge systems.

It is an object, feature and advantage of the present invention to provide a purge tank for condensing condensable gases and accumulating noncondensable gases where the purge tank includes baffles.

It is a further object and feature of the present invention that these baffles comprise flat copper discs brazed directly to the top and bottom of an evaporator coil located within the purge tank.

It is an object, feature and advantage of the present invention to increase the rate of removal of noncondensable gases.

It is a further object, feature and advantage of the present invention to modulate the pumpout compressor flow capacity. In one embodiment, this is accomplished by cycling the compressor or its flow components. Cycling flow components includes controlling a pumpout solenoid valve on the suction side of a pumpout compressor during a pumpout cycle.

It is a further object, feature and advantage of the present invention that the solenoid valve be pulsed on and off when the pumpout cycle is initiated so that an adaptive setpoint for the pumpout compressor capacity can be adjusted to full capacity when a feedback sensor indicates that a need for full capacity exists.

It is a still further object, feature and advantage of the present invention that the value of a feedback sensor be measured and compared to a setpoint value to determine whether the pumpout cycle should be initiated, continue or cease.

It is an object, feature and advantage of the present invention to provide adaptive pumpout setpoints that vary during the pumpout cycle.

It is a further object, feature and advantage of the present invention that these adaptive pumpout setpoints be determined as a function of the temperature of condensed liquid refrigerant being returned to the chiller system.

The present invention provides a purging device for a system accumulating condensable and non-condensable gases. The purging device comprises: a purge tank; an inlet connection to the purge tank for receiving the condensable and non-condensable gases from the system and directing said gases into the purge tank; refrigeration means associated with the purge tank for condensing the non-condensable gases into a condensed form; header space in the purge tank for accumulating the non-condensable gases; a first outlet connection for returning the condensed gases from the purge tank to the system; a second outlet for controllably removing the accumulated non-condensable gases from the header space; and a baffle in the purge tank for providing a controlled flow space for the condensable and non-condensable gases and providing a quiet zone in the header spacer.

The present invention also provides a device for separating non-condensable gases from condensable gases. The device comprises: a separation tank having an inlet and an outlet; a heater located in proximity with the separation tank and providing a source for heating the tank; a substance having an affinity for one of the condensable gases and a heat exchanger located within the separation tank in heat exchange relationship with the heater and the substance. The substance is located within the separation tank between the inlet and the outlet so as to capture the gas for which the substances affinity lies. The substance releases the captured gas in response to the application of heat by the heater, and/or reduction of pressure by connection to the low pressure point of the chiller.

The present invention additionally provides a method of determining a setpoint for a purge system. The method comprises the steps of: determining a chiller condensing temperature based upon a temperature of condensed liquid being returned from the purge system to a system being purged; determining a pumpout initiate setpoint as a function of the purge liquid temperature.

The present invention further provides a method of determining a setpoint for a purge system. The method comprises the steps of: determining a chiller condensing temperature based upon a temperature of condensed liquid being returned from the purge system to a system being purged; determining a pumpout terminate setpoint as a function of the purge liquid temperature.

The present invention still further provides a method of determining setpoints for a purge system. The method comprises the steps of: determining a chiller condensing temperature based upon a temperature of condensed liquid being returned from the purge system to a system being purged; determining a pumpout initiate setpoint as a function of a purge operating condition; and determining a pumpout terminate setpoint as a function of the purge operating condition.

The present invention moreover provides a method of controlling the pumpout of a purge tank which contains non-condensable gases extracted from a refrigeration system. The method comprising the steps of: pulsing an outlet control valve for a predetermined amount of time; determining a pumpout initiate setpoint; measuring temperature associated with the purge tank; comparing the measured temperature with the initiate setpoint; initiating continuous pumpout if the suction temperature is less than the initiate setpoint; determining a terminate setpoint; and comparing the suction temperature to the terminate setpoint and terminating pumpout if the measured temperature is greater than the terminate setpoint.

The present invention yet further provides a method of adaptively controlling the operation of refrigeration system. The method comprises the steps of: monitoring the operation of a chiller to determine the time when the chiller is on and the time when the chiller is off; monitoring the operation of a purge system removing non-condensable gases from the chiller to determine when the chiller is pumping out non-condensable gases in terms of when the chiller is on and off; and adaptively modifying the control of the purge in response to the monitored data.

DETAILED DESCRIPTION OF THE DRAWINGS

Figure 1:
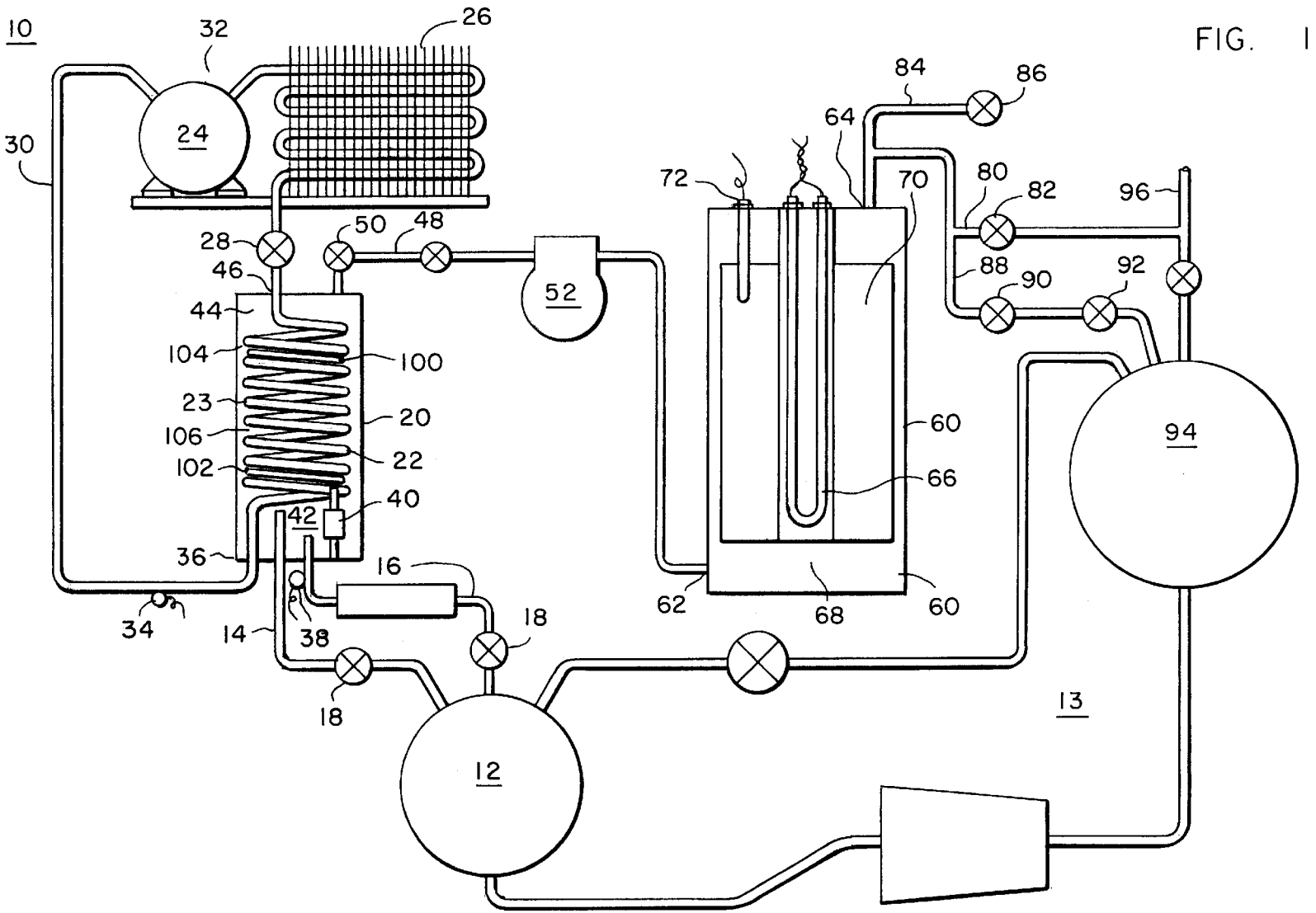
FIG. 1 is a schematic drawing of a purge system in accordance with the present invention.

FIG. 1 shows a purge system 10 connected to the condenser 12 of a chiller system 13 by a supply line 14 and a return line 16. Isolation valves 18 are included in each of the supply and return lines 14, 16.

The purge system 10 includes a purge tank 20 to which the supply line 14 and the return line 16 connect. The purge tank 20 is a sealed tank enclosing a heat exchanger acting as an evaporator 22. The evaporator 22 may be implemented as a copper coil 23. The evaporator 22 is preferably part of a refrigeration system 32 including the evaporator, a compressor 24, condenser 26 and an expansion device 28 all serially linked by refrigeration tubing 30 into a refrigeration circuit to form the refrigeration system 32.

The refrigeration system 32 includes a temperature sensor 34 located in the tubing 30 in proximity to the evaporator outlet 36. A liquid temperature sensor 38 is provided in the return line 16 to measure the temperature of liquid refrigerant condensed by the evaporator 22 and being returned to the condenser 12. In an alternative arrangement, this temperature information may be obtained from a temperature sensor (not shown) in the condenser sump when the chiller is on, and from an evaporator temperature sensor (not shown) when the chiller is off.

The purge tank 20 includes a float switch 40 to measure and detect the accumulation of liquid refrigerant in a bottom area 42 of the purge tank 20. The float switch 40 inhibits operation if liquid accumulates.

The purge tank also includes a header space 44 wherein noncondensable gases accumulate after the operation of the evaporator 22 condenses the condensable gases into a liquid form. The purge tank 20 includes a header outlet 46 and a header outlet line 48 to allow the noncondensable gases to be removed from the header space 44. A pumpout solenoid valve 50 is provided in the header line 48 to control the removal of the noncondensable gases. A pumpout compressor 52 is located in the header line 48 so as to provide a motivating force for the removal of the noncondensable gases from the header space 44.

The header line 48 leads to a separation tank 60 filled with a substance having an affinity for a condensable gas. Preferably, the separation tank 60 is filled with an activated carbon having an affinity for many system refrigerants including CFC11, CFC113 and HCFC123. The separation tank 60 includes an inlet 62, an outlet 64 and an electric heater 66 located within the separation tank 60. The separation tank 60 is filled with the carbon 68 and a heat exchanger 70 is operably connected between the heater 66 and the carbon 68 to enhance the heat exchange relationship therebetween. The separation tank 60 also includes a temperature sensor 72 to measure the temperature within the separation tank 60 and control the operation of the electric heater 66. The outlet 64 of the separation tank 60 includes connections to an exhaust line 80 under the control of an exhaust valve 82, to a pressure relief line 84 under the control of a pressure relief device 86, and a second return line 88 under the control of a regeneration valve 90 and an isolation valve 92. The second return line 88 preferably returns to an evaporator 94 of the chiller system 13. The exhaust line 80 is connected to a chiller vent line or an area of safe exhaust 96.

The purge tank 20 includes baffles 100 and 102 respectively located in an upper area 104 and a lower area 106 of the purge tank 20. The baffles 100, 102 act to provide a controlled flow space for the condensable and noncondensable gases and a quiet zone in the header space where the non-condensable gases may accumulate. In operation, the baffles 100, 102 also serve to direct the gases into condensing contact with the coil 23. The baffles 100 and 102 are preferably braised, welded or otherwise affixed to the copper coil 23 of the evaporator 22 within the purge tank 20.

In operation, the purge system 10 is turned on and the purge evaporator 22 condenses the condensable gases present in the purge tank 20, transforming or coalescing the condensable gases into a liquid form which then returns through the return line 16 to the chiller system 13. The partial vacuum created within the purge tank 20 causes more condensable and noncondensable gases to enter through the supply line 14 to the purge tank 20 where the condensable gases continue to condense into liquid form and return to the chiller system 13. Eventually the header space 44 begins to fill with noncondensable gases and begins to effect the efficiency and operation of the purge evaporator 22 as measured by the temperature sensor 34 (or other detection means such as a pressure sensor or the like). At such time, a pumpout cycle may be initiated. In a pumpout cycle, the normally closed valve 50 and 82 are opened and the pumpout compressor 52 is turned on to cause the noncondensable gases to flow out the header line 48 into the separation tank 60. In the separation tank 60, any condensable gases still flowing with the noncondensable gases are attracted to the activated carbon 68 in the separation tank 60 and bond thereto, leaving only the purified noncondensable gases to flow out the now open exhaust valve 82 to the vent area 96.

Figure 2:
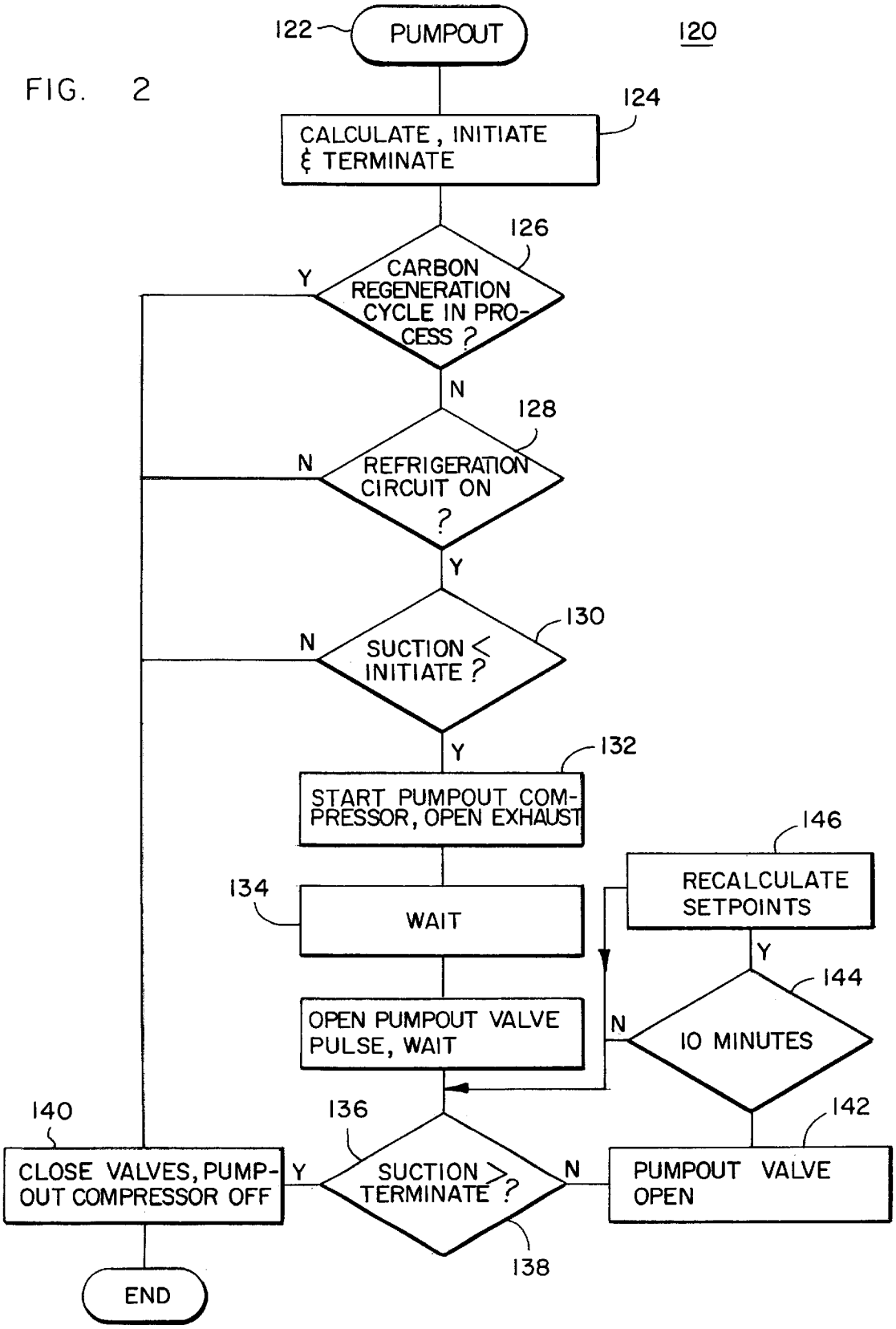
FIG. 2 is a flow chart of pumpout control logic in accordance with the present invention.

The actual pumpout control is described with respect to the flow chart 120 of FIG. 2.

The pumpout cycle begins at step 122 and proceeds to step 124 where initiate and terminate setpoints are calculated. The initiate setpoint and the terminate setpoints are calculated as a function of the purge liquid temperature measured by the temperature sensor 38 in the return line 16. Preferably the initiate setpoint is equal to the measured purge liquid temperature minus 50° F., whereas the terminate setpoint is determined by the purge liquid temperature minus 40° F. Of course, a person of ordinary skill in the art will recognize that other methods of calculating these setpoints may be employed.

Periodically, the accumulated condensables with their affinity for the carbon 68 must be regenerated so that the carbon can be purified to improve its efficiency and so that the refrigerant condensables may be returned to the chiller system 13. This is accomplished by activating the electric heater 66 under the control of the temperature sensor 72. The addition of considerable heat and reduction of pressure to the carbon 68 in the separation tank 60 acts to break the affinity between the carbon 68 and the refrigerant gases. These gases are then drawn through the line 88 through the now open valve 90 and back to the chiller evaporator 94.

At step 126 a determination is made as to whether a regeneration cycle is in progress regenerating the carbon 68 in the separation tank 60. Only if such a process is not ongoing will the flow chart 120 continue to step 128.

At step 128 the determination is made that the purge refrigeration circuit 32 is on. If so, then at step 130, the temperature measured by sensor 34 is compared to the initiate setpoint. If the measured temperature is less than the initiate setpoint, then the pumpout control continues to step 132.

At step 132, the valve 82 is opened, the pumpout compressor 52 is turned on, and a short delay is indicated by step 134. After this delay, preferably of 5 seconds amount of time, the valve 50 is pulsed at step 136 to an open position for 20 seconds, then pulse closed for 20 seconds and the cycle then repeated one more time followed by a short delay. After this delay, the suction temperature is compared at step 138 to the terminate setpoint. If the suction temperature is greater than the terminate setpoint, then the pumpout cycle is ended at step 140 by closing the valve 82 and turning off the pumpout compressor 52.

However, if the step 138 did not determine that the suction temperature was greater than the terminate setpoint, then the valve 50 is opened at step 142 and the pumpout cycle continues in a cycle of steps 138, 142 and 144. Step 144 causes step 146 to be implemented every 10 minutes. Step 146 recalculates the initiate and terminate setpoints using the same method as they were initially calculated at step 124 as a function of the liquid temperature measured by the sensor 38. This of course, causes the termination at step 138 to vary as setpoints, are periodically updated and causes the overall purge pumpout cycle to operate much more efficiently and quickly.

What is desired to be secured as Letters Patent is set forth in the following claims:

1. A method of determining a setpoint for a purge system comprising the steps of:

determining a temperature of condensed liquid being returned from the purge system to a system being purged; and determining a pumpout initiate setpoint as a function of the purge liquid temperature.

2.The method of claim 1 wherein determining the purge initiate setpoint includes the step of subtracting a predetermined value from the purge liquid temperature as measured.

3. The method of claim 2 wherein the predetermined value is approximately 50 F.

4. The method of claim 2 including the further step of controlling the operation of the purge system as a function of the purge initiate setpoint.

5. A system for determining a setpoint for a purge system comprising:

means for determining a temperature of condensed liquid being returned from the purge system to a system being purged; and means for determining a pumpout initiate setpoint as a function of the purge liquid temperature.

6. The system of claim 5 wherein the initiate setpoint determining means includes means for subtracting a predetermined value from the purge liquid temperature as measured.

7. The system of claim 6 wherein the predetermined value is approximately 50 F.

8. The system of claim 5 further including means for controlling the operation of the purge system as a function of the purge initiate setpoint.

9. A method of determining a setpoint for a purge system comprising the steps of:

determining a temperature of condensed liquid being returned from the purge system to a system being purged; and determining a pumpout terminate setpoint as a function of the purge liquid temperature.

10. The method of claim 9 wherein determining the purge terminate setpoint includes the step of subtracting a predetermined value from the purge liquid temperature as measured.

11. The method of claim 10 wherein the predetermined value is approximately 40 F.

12. The method of claim 11 including the further step of controlling the operation of the purge system as a function of the pumpout terminate setpoint.

13. The method of claim 9 wherein the condensed liquid temperature provides a chiller condenser temperature, which in turn is used to determine the pumpout terminate setpoint.

14. A system for determining a setpoint for a purge system comprising:

means for determining a temperature of condensed liquid being returned from the purge system to a system being purged; and means for determining a pumpout terminate setpoint as a function of the purge liquid temperature.

15. The system of claim 14 wherein the purge terminate setpoint determining means includes means for subtracting a predetermined value from the purge liquid temperature as measured.

16. The system of claim 15 wherein the predetermined value is approximately 40° F.

17. The system of claim 14 including means for controlling the operation of the purge system as a function of the pumpout terminate setpoint.

18. A method of determining setpoints for a purge system comprising the steps of:

determining a temperature of condensed liquid being returned from the purge system to a system being purged;

determining a pumpout initiate setpoint as a function of a purge operating condition; and determining a pumpout terminate setpoint as a function of the purge operating condition.

19. The method of claim 18 wherein the purge operating condition is the purge liquid temperature and wherein determining the purge initiate setpoint includes the step of subtracting a predetermined value from the purge liquid temperature as measured.

20. The method of claim 19 wherein determining the purge terminate setpoint includes the step of subtracting a predetermined value from the purge liquid temperature as measured.

21. The method of claim 20 wherein the predetermined value is approximately 40 F.

* * * * *